US007739765B2

(12) United States Patent
Ashrafzadeh et al.

(10) Patent No.: US 7,739,765 B2
(45) **Date of Patent: *Jun. 22, 2010**

(54) TANGLING DETECTION FOR AN AUTOMATIC WASHER

(75) Inventors: Farhad Ashrafzadeh, Stevensville, MI (US); Kalyanakrishnan Vadakkeveedu, College Station, TX (US); Raveendran Vaidhyanathan, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 717 days.

This patent is subject to a terminal disclaimer.

(21) Appl. No.: 11/595,647

(22) Filed: Nov. 9, 2006

(65) Prior Publication Data

US 2008/0109967 A1 May 15, 2008

(51) Int. Cl.
*D06F 35/00* (2006.01)

(52) U.S. Cl. ..... 8/159; 68/12.02; 68/12.04; 68/12.06

(58) Field of Classification Search ..... 68/12.02, 68/12.04, 12.06, 12.16, 12.17, 12.23; 8/158, 8/159

See application file for complete search history.

(56) References Cited

U.S. PATENT DOCUMENTS

| | | | | |
|---|---|---|---|---|
| 4,553,413 | A | 11/1985 | Genji et al. | 68/12 |
| 5,070,565 | A | 12/1991 | Sood et al. | 8/159 |
| 5,293,760 | A * | 3/1994 | Tani et al. | 68/12.02 |
| 5,339,474 | A | 8/1994 | Kim et al. | 8/159 |
| 5,677,606 | A | 10/1997 | Otake | 318/434 |
| 6,163,912 | A | 12/2000 | Matsuura et al. | 8/159 |
| 6,240,586 | B1 | 6/2001 | Joo | 8/159 |
| 6,477,867 | B1 | 11/2002 | Collecutt et al. | 68/12.06 |
| 6,665,625 | B2 | 12/2003 | Stalsberg | 702/104 |
| 6,715,175 | B2 | 4/2004 | Ciancimino et al. | 8/159 |

FOREIGN PATENT DOCUMENTS

| | | |
|---|---|---|
| EP | 1113102 | 4/2001 |

* cited by examiner

*Primary Examiner*—Michael Barr
*Assistant Examiner*—David Cormier
(74) *Attorney, Agent, or Firm*—Clifton G. Green; McGarry Bair PC

(57) ABSTRACT

A method and apparatus for determining the degree of tangling of fabric items during a wash process based on at least one of the motor speed or motor current.

15 Claims, 11 Drawing Sheets

TANGLING DETECTION FOR AN AUTOMATIC WASHER

BACKGROUND OF THE INVENTION

1. Field of the Invention

The invention relates to a method for detecting tangling of articles in an automatic clothes washer.

2. Description of the Related Art

Automatic clothes washers are ubiquitous. Such appliances clean fabric items effectively, enabling the homeowner to complete other tasks or engage in more satisfying activities while doing the laundry. Modern clothes washers provide a multitude of options for matching a selected cleaning operation to the type of fabric comprising the laundry load and the degree of soiling of the laundry load. This includes setting a liquid level appropriate to the size and fabric type of the laundry load. Modern clothes washers also include sophisticated controllers that are programmed to maximize cleaning efficiency while minimizing water and power consumption. However, despite the capabilities of the modern clothes washer, the appliance remains limited in its ability to detect tangling and then adjust the wash cycle based on real-time information relating to the fabric items being washed.

One type of conventional automatic clothes washer may be provided with a drive motor, generally electrically powered, which may be used to drive a cylindrical perforate basket during a spin cycle, and a clothes mover during wash and rinse cycles for agitating the laundry load within the basket.

In a conventional automatic clothes washer, cleaning of the fabric items may be primarily attributable to three factors: chemical energy, thermal energy, and mechanical energy. These three factors may be varied within the limits of a particular automatic clothes washer to obtain the desired degree of cleaning.

The chemical energy relates to the types of wash aids, e.g. detergent and bleach, applied to the fabric items. All other things being equal, the more wash aid used, the greater will be the cleaning effect.

The thermal energy relates to the temperature of the fabric items. The temperature of the wash liquid typically constitutes the source of the thermal energy. However, other heating sources may be used. For example, one known way uses steam to heat the fabric items. All things being equal, the greater the thermal energy, the greater will be the cleaning effect.

The mechanical energy may be attributed to the contact between the clothes mover and the fabric items, the contact between the fabric items themselves, and the passing of the washing liquid through the fabric items. In washing machines with a fabric mover, the fabric mover tends to cause the fabric items to contact themselves, and for the wash liquid to pass through the fabric items. All things being equal, the greater the amount of mechanical energy, the greater will be the cleaning effect.

These three factors may be adjusted to obtain the desired cleaning effect. For example, while the direct contact between the clothes mover and the fabric items may be beneficial for laundering, it does cause greater physical wearing of the fabric items than the other two factors. Thus, for example, for more delicate clothing, it may be desired to reduce the direct contact. However with contemporary washing machines, it has not yet been possible to determine the mechanical energy imparted to the fabric items during the washing process. Thus, contemporary solutions are based on estimates or empirical data, both of which are typically determined based on a set of standard test conditions. Unfortunately, these standard test conditions are not guaranteed to be repeated when the consumer uses the clothes washer, resulting in a compromised cleaning result. It would be advantageous to the overall cleaning performance if the mechanical energy imparted to the fabric items could be determined during the washing process.

SUMMARY OF THE INVENTION

A method and apparatus for determining the degree of tangling of fabric items during a wash process based on at least one of the motor speed or motor current.

DESCRIPTION OF AN EMBODIMENT OF THE INVENTION

The invention relates to a method of determining the degree of tangling of articles in a clothes washer based upon the engagement of a clothes mover with fabric items in a laundry load. The invention may also include a method for adjusting the wash cycle based on the determined tangling. The method utilizes operational characteristics of a drive motor, such as current and speed, to determine the degree of tangling of the clothes articles. The degree of tangling of the clothes articles may be compared with pre-determined threshold for the degree of tangling to control the operating cycle by setting the agitator stroke, or by stopping the cycle.

Conventional automatic clothes washers enable a user to select one of several laundering options based upon the type of laundry load being placed in the clothes washer. For example, selectable options may include "normal," "delicates," "woolens," and the like. These are typically referred to as "cycles." As utilized herein, "laundering cycle" will refer to a specific cycle, such as "normal," extending from the beginning of the cycle to its completion. A laundering cycle will generally consist of at least a wash cycle, a rinse cycle, and a spin cycle. The wash cycle, the rinse cycle, and the spin cycle may consist of several steps, such as a fill step, a drain step, a pause step, an agitation step, and the like. The invention may be used with any cycle regardless of the types and combination of steps.

Figure 1:
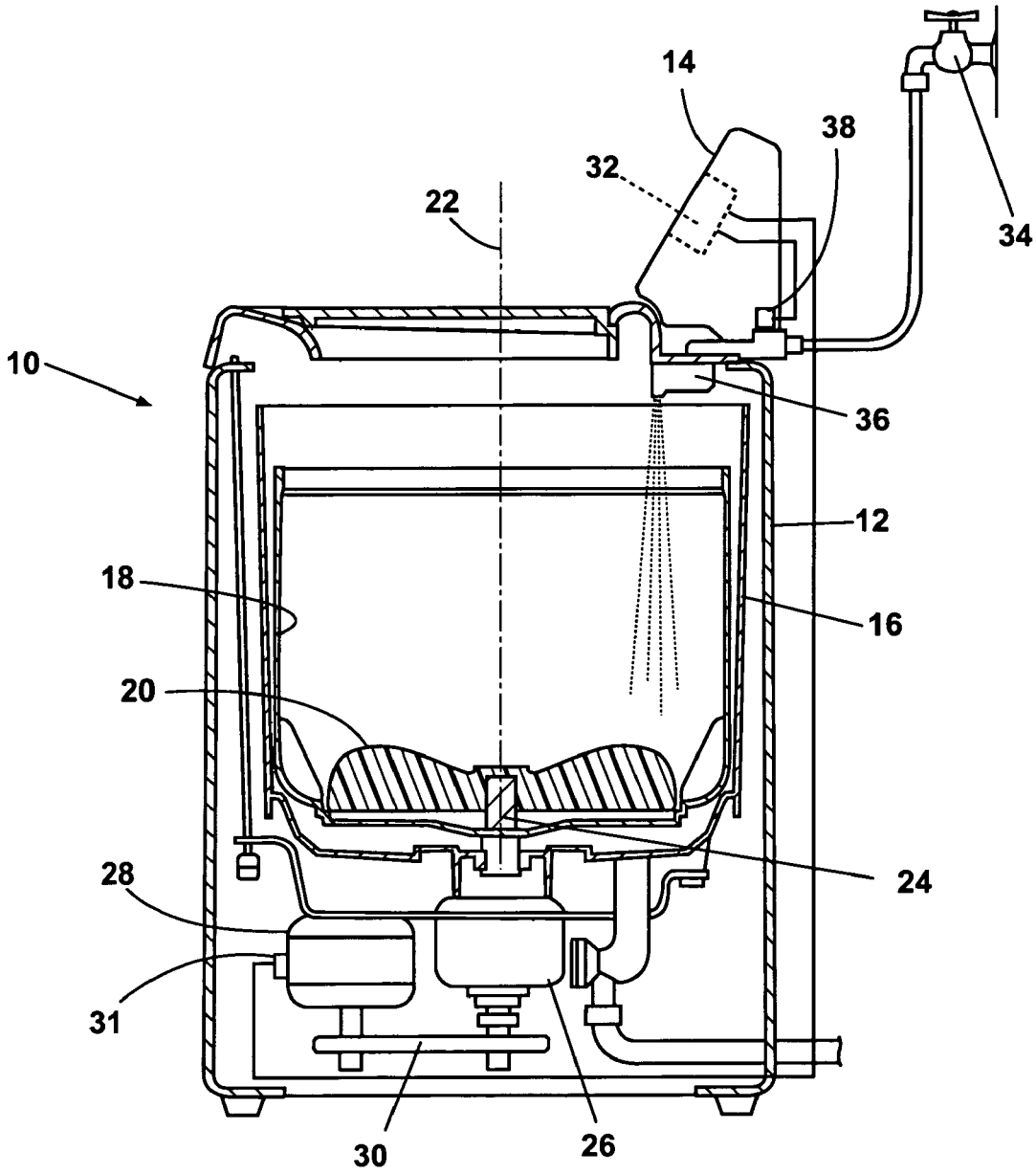
FIG. 1 is a partially cut away elevational view of an automatic clothes washer according to the invention illustrating relevant internal components thereof, including a clothes basket, and a clothes mover.

FIG. 1 illustrates an embodiment of the invention consisting of a vertical axis automatic clothes washer 10 comprising a cabinet 12 having a control panel 14, and enclosing a liquid-tight tub 16 defining a wash chamber in which may be located a perforate basket 18. Thus, fabric items placed in the basket 18 are placed in the wash chamber. A clothes mover 20 adapted for imparting movement to a laundry load contained within the basket 18 may be disposed in the bottom of the basket 18. The clothes mover 20 has been illustrated as a low profile vertical axis impeller. However, the clothes mover 20 may also be a vertical axis agitator, with or without an auger, or a basket adapted with peripheral vanes. The clothes mover 20 and basket 18 may be coaxially aligned with respect to a vertically oriented oscillation axis 22.

While the invention will be illustrated with respect to a low profile impeller, other clothes movers may be utilized without departing from the scope of the invention. For example, it has been contemplated that the invention has applicability to horizontal axis washers as well as to the vertical axis washers. For purposes of this application, horizontal axis washer refers to those types of washers that move the fabric items primarily by lifting the fabric items and letting them fall by gravity, regardless of whether the axis of rotation remains primarily horizontal, and vertical axis washer refers to those types of washers that move fabric items by a clothes mover, regardless of whether the axis of rotation remains primarily vertical.

The clothes mover 20 may be operably coupled with a drive motor 28 through an optional transmission 26 and drive belt 30. One or more well-known sensors 31 for monitoring angular velocity, current, voltage, and the like, may be operably coupled with the motor 28. Outputs from the sensors 31 may be delivered to a machine controller 32 in the control panel 14. In many applications, the sensors 31 form part of a motor controller coupled with the machine controller 32. The machine controller 32 may be adapted to send and receive signals for controlling the operation of the clothes washer 10, receiving data from the sensors 31, processing the data, displaying information of interest to a user, and the like.

The clothes washer 10 may also be coupled with a source of water 34 which may be delivered to the tub 16 through a nozzle 36 controlled by a valve 38 operably coupled with the machine controller 32. The valve 38 and the machine controller 32 may enable a precise volume of water to be delivered to the tub 16 for washing and rinsing.

Figure 2:
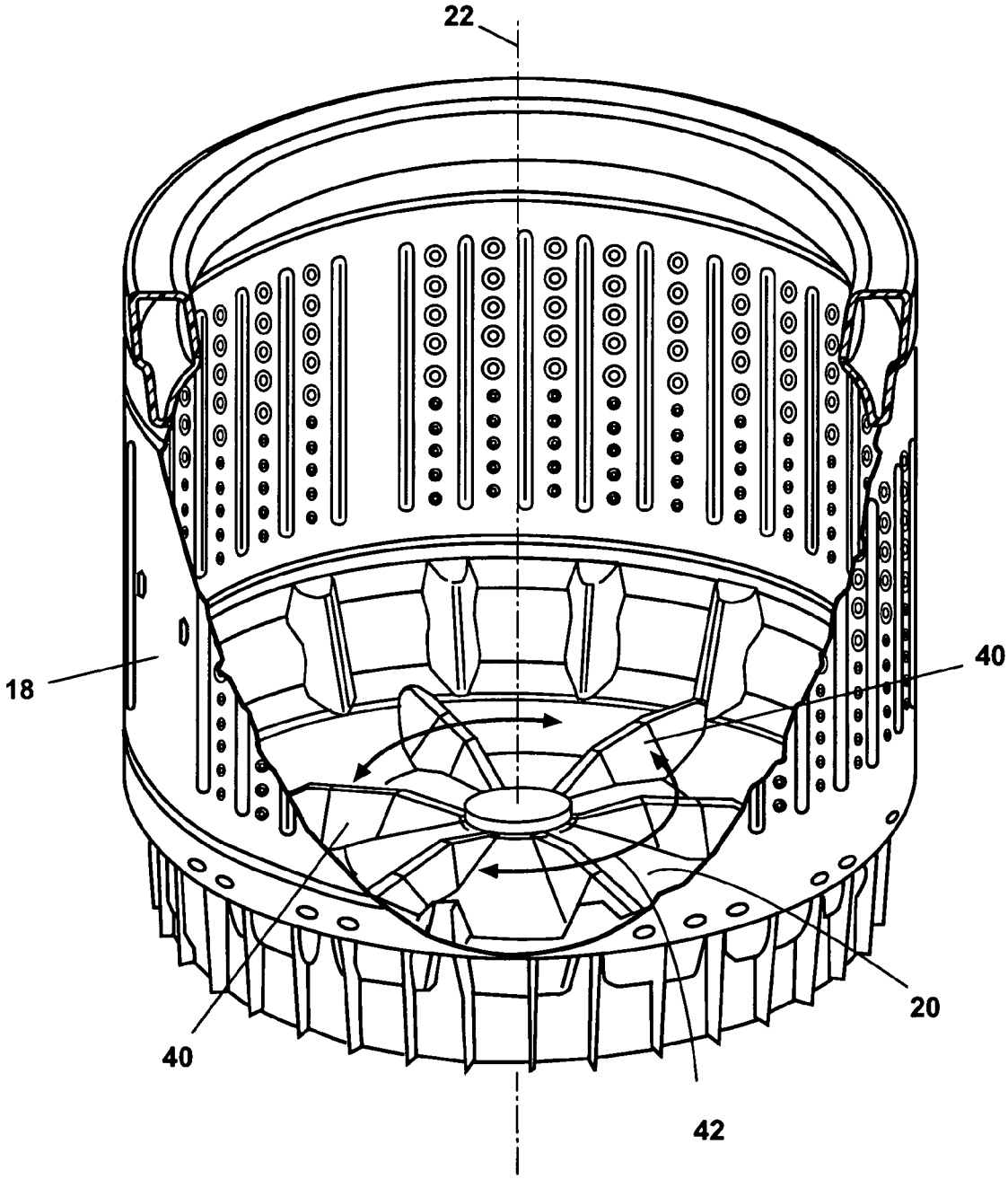
FIG. 2 is a partially cut away perspective view of the clothes basket and clothes mover illustrated in FIG. 1.

FIG. 2 illustrates an embodiment of the invention with the clothes basket 18 and the clothes mover 20 in coaxial alignment with the oscillation axis 22. The clothes mover 20 may be a somewhat circular, plate like body having a plurality of radially disposed vanes 40 extending upwardly there from The vanes 40 may be adapted to contact and interact with fabric items and liquid in the basket 18 for agitating the fabric items and the liquid. During a wash cycle and a rinse cycle, the clothes mover 20 may be driven by the drive motor 28 for movement within the wash chamber. The basket 18 may be braked to remain stationary during the movement of the clothes mover 20, or the basket 18 may freely rotate during the movement of the clothes mover 20

The drive motor 28 may drive the clothes mover 20 in an oscillating manner, first in a forward direction, referred to herein as a forward stroke, then in a backward direction, referred to herein as a backward stroke. The clothes mover 20 may move in a forward direction through a preselected angular displacement, for example ranging from 180° to 720°. The clothes mover 20 may move in a backward direction through a similar preselected angular displacement. A complete forward stroke and backward stroke are referred to herein as an oscillation cycle.

For clothes movers that move rotationally, the forward and backward strokes are often referred to as the clockwise and counterclockwise strokes. While typically the forward stroke constitutes the clockwise stroke and the backward stroke constitutes the counterclockwise stroke, these relationships may easily be reversed.

In a typical wash cycle, multiple fabric items, which collectively form a laundry load, are placed in the basket on top of the clothes mover 20. Some of the fabric items will be in direct contact with the clothes mover 20 and some will not. As the clothes mover 20 moves, the individual fabric items will be moved directly or indirectly by the clothes mover 20 to impart mechanical energy to the items, which will move the fabric items about the interior of the wash chamber.

Figure 3:
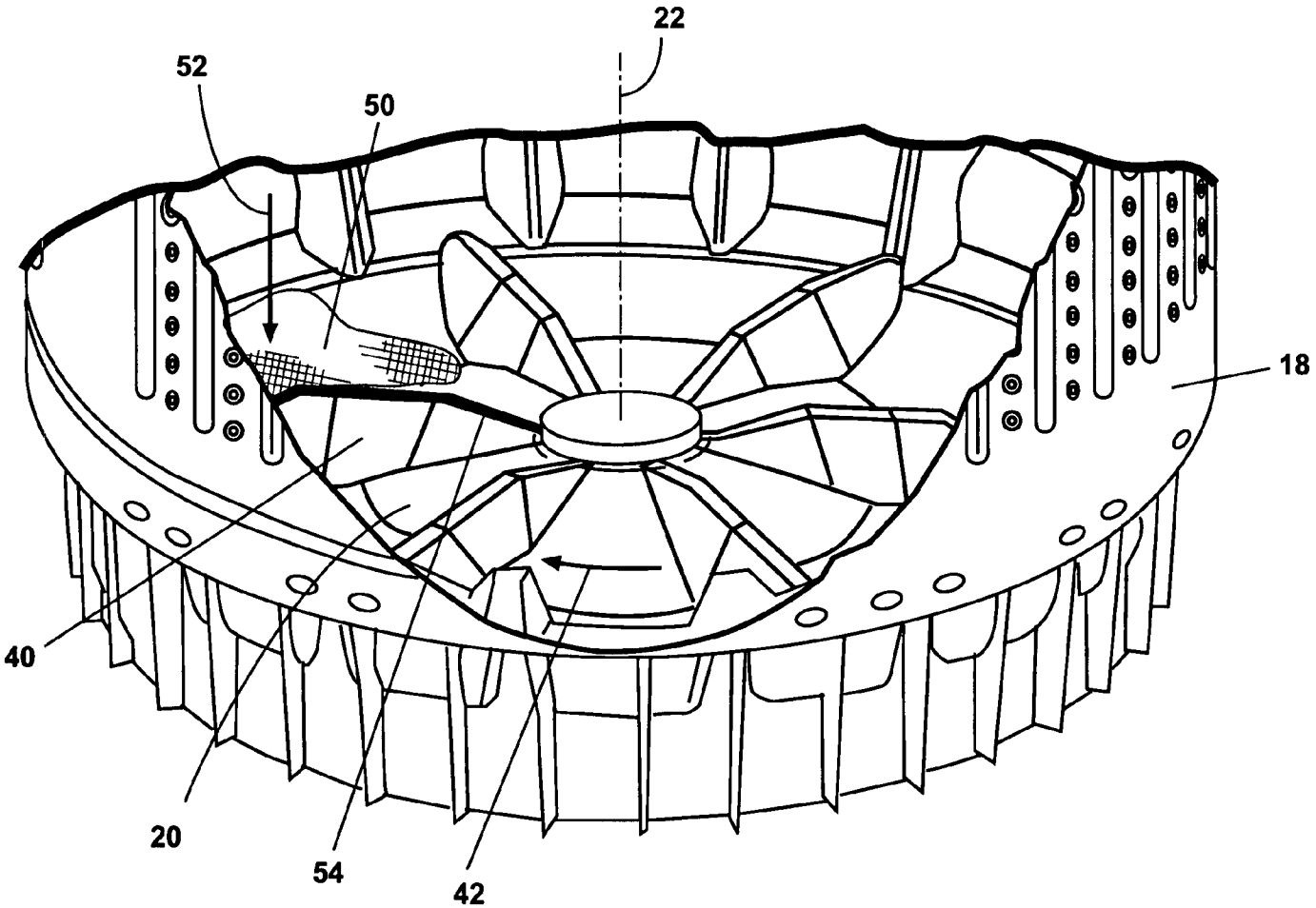
FIG. 3 is a partially cut away enlarged view of the clothes basket and clothes mover illustrated in FIG. 2 showing an article of clothing in a first configuration relative to the clothes mover.

In FIG. 3, an embodiment of the invention shows a single fabric item 50 in a lower portion of a laundry load will be in contact with the clothes mover 20. The illustration does not include liquid for clarity; however, it should be understood that liquid exists and it may be at any level from just wetting the fabric items to fully submerging the fabric items. The fabric item 50 may be represented by a downwardly directed weight factor 52. The vanes 40 terminate in an upper vane edge 54. All or part of the vane 40 may contact the fabric item 50 during the forward and backward strokes of the clothes mover 20. As the clothes mover 20 rotates in a forward stroke, represented by the motion vector 42, a vane 40 may be brought into contact with the fabric item 50.

Figure 4:
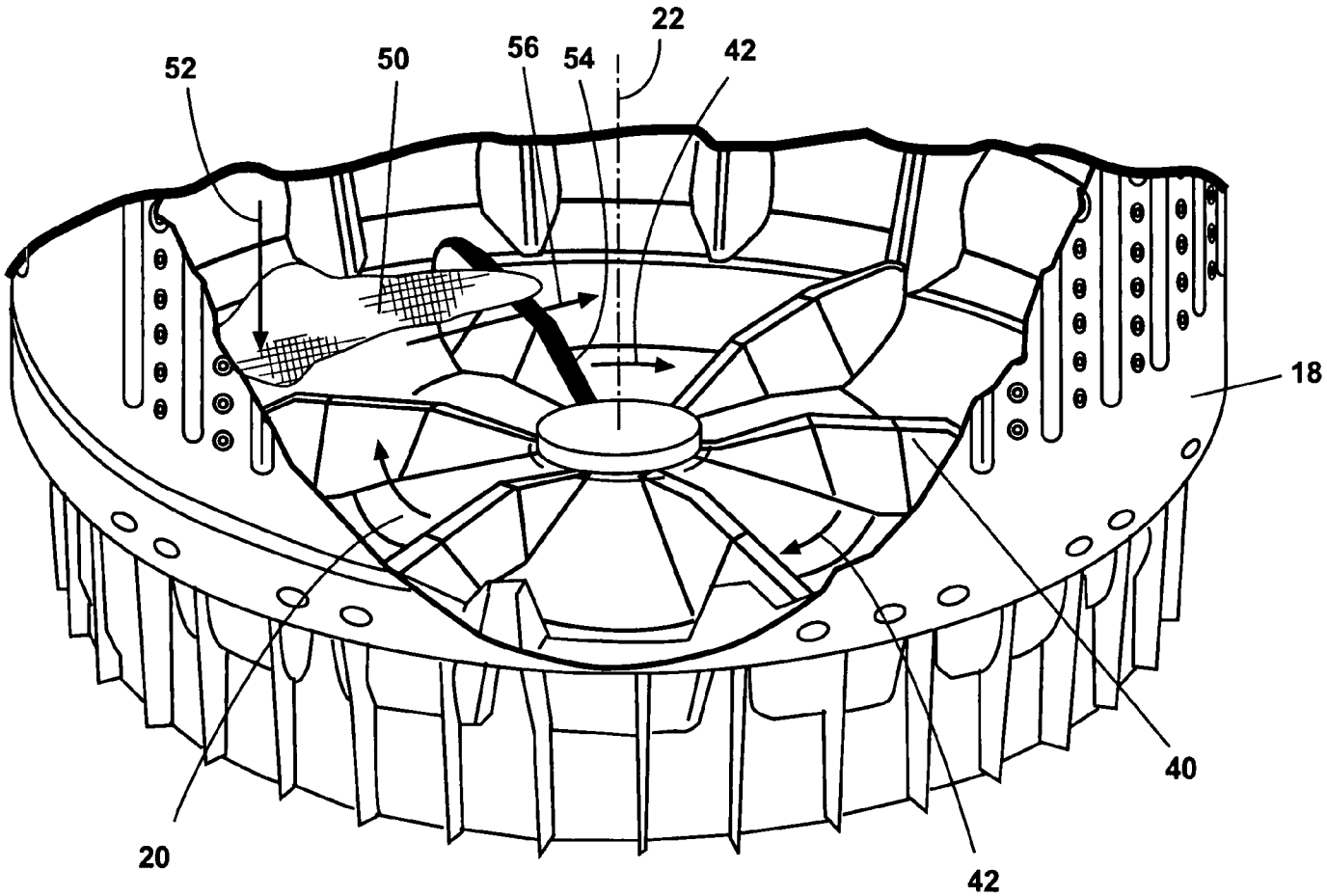
FIG. 4 is a view of the clothes basket and clothes mover illustrated in FIG. 3 showing the article of clothing in a second configuration relative to the clothes mover.
Figure 5:
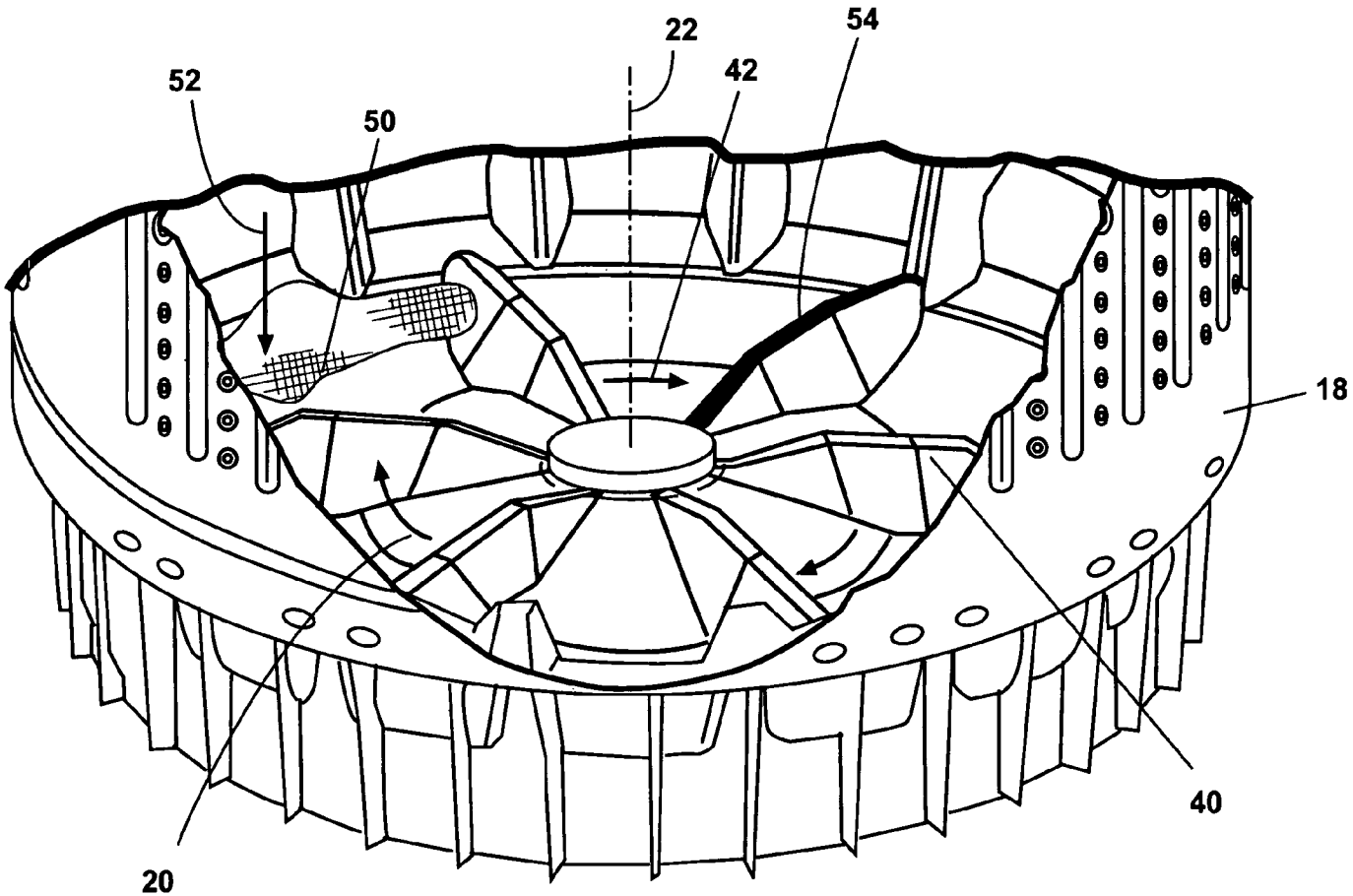
FIG. 5 is a view of the clothes basket and clothes mover illustrated in FIG. 3 showing the article of clothing in a third configuration relative to the clothes mover.

FIG. 4, shows an embodiment where the contacting of the vane 40 with the fabric item 50 tends to move the fabric item 50 in the direction of rotation of the clothes mover 20, represented by the pull vector 56. Because of the weight of the fabric item 50, the weight of overlying fabric items, the frictional relationship between the fabric item 50 and the vane edge 54, the degree of wetting of the fabric item 50, and other factors, there may be intermittent grabbing and slipping by the vane 40 relative to the fabric item 50 which will be reflected in movement of the fabric item 50 that may not be the same rotational distance as the clothes mover 20, resulting in relative movement between the fabric item 50 and the clothes mover 20. As illustrated in FIG. 5, if sufficient slippage exists, at some point during the forward stroke the vane 40 may separate from the fabric item 50.

The intermittent grabbing and slipping of the vane 40 with respect to the clothes mover 20 results in an intermittent application of the weight of the fabric item 50 to the clothes mover 20, which amounts to a loading and unloading of the clothes mover 20. The loading and unloading present themselves as a change in speed of the clothes mover 20, that may be sensed by the sensors 31. In response, the controller 32, which typically tries to move the motor 28 at a predetermined set speed for the given cycle, will increase or decrease the current to the motor 28 to attempt to maintain the set speed.

The magnitude and frequency of grabbing and slipping may be impacted by several factors, only some of which will now be described. The greater the size laundry load, the greater will be the weight of other fabric items bearing on the fabric item in direct contact with the clothes mover 20. The increased volume of the greater laundry load will also tend to inhibit the free movement of the fabric items within the wash chamber.

Wet fabric items tend to create greater frictional resistance with the clothes mover than dry fabric items. However, as liquid level increases in the wash chamber to the point where the fabric items are fully submerged, the additional liquid brings into effect the buoyancy of the fabric items, which has an opposite effect than the weight force of the fabric items. In some instances, the liquid may be sufficiently deep and the clothes mover may sufficiently agitate the liquid that some or all of the fabric items are suspended in the liquid above the clothes mover 20, which will greatly reduce the loading of the clothes mover 20 by the fabric items. Thus, all things being equal, the deeper the liquid, the greater the degree of loading and unloading will be minimized.

Additional wash liquid also tends to interfere with the clothes mover's 20 ability to reverse the direction of the fabric items when the clothes mover 20 switches direction between the forward and backward strokes. For example, when the clothes mover 20 moves in a forward stroke, it causes not only the fabric items to move in the forward stroke direction, but also the liquid in the wash chamber to move in a forward stroke direction. Upon reversing to the backward stroke, fabric items in direct contact with the clothes mover 20 will tend to follow the reverse stroke direction of the clothes mover 20. However, the liquid, especially the liquid above the clothes mover 20, will tend to maintain movement in the forward stroke direction because of its momentum. Thus, the reversal of the clothes mover 20 does not necessarily result in all of the fabric items and liquid in the washer chamber reversing direction in time with the clothes mover 20.

Figure 6:
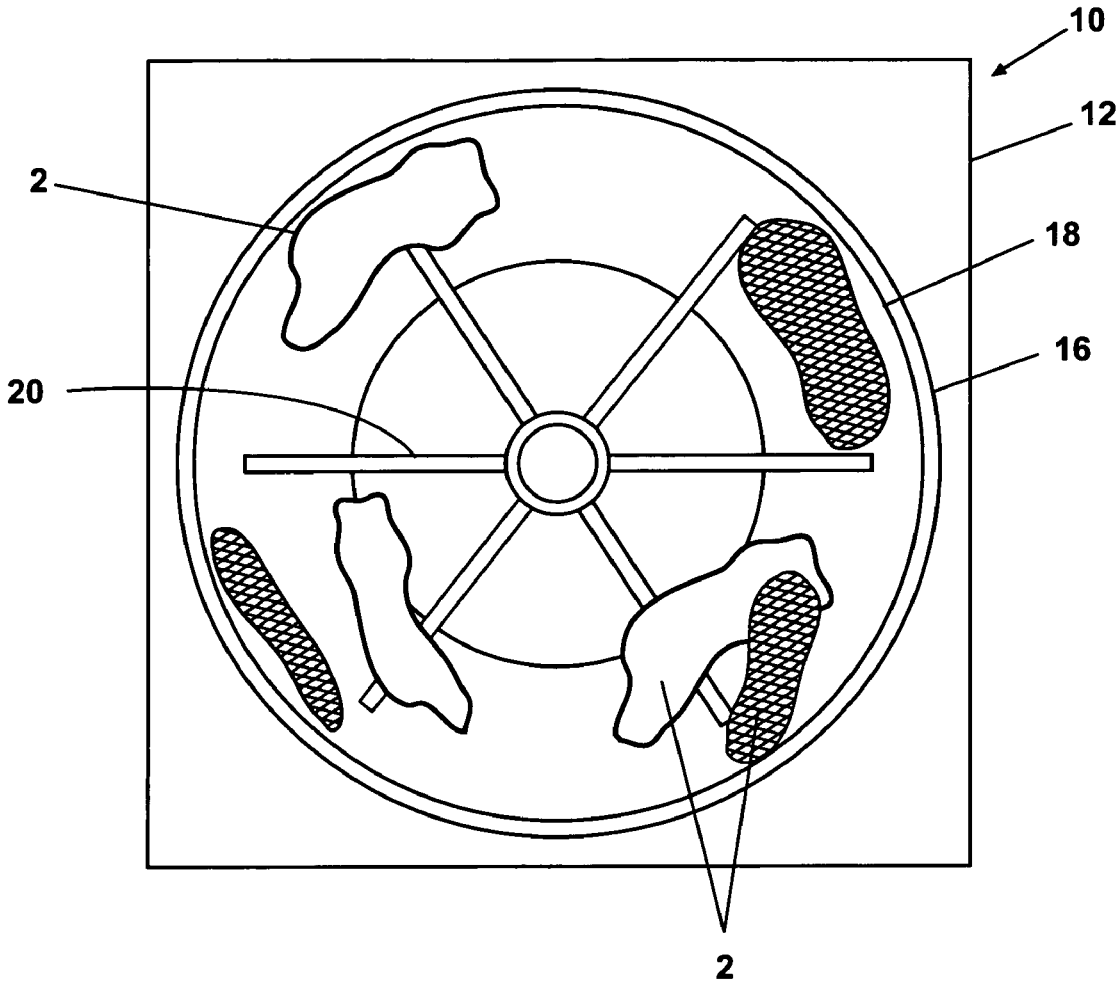
FIG. 6 is a schematic representation of fabric items in an un-tangled state in the cloths basket.

FIG. 6 schematically represents of a fabric load comprising fabric items 2 shown in an un-tangled state. Fabric items 2 are considered not tangled where they are relatively untwisted and unwound in the wash basket 18. Fabric articles that are not tangled or twisted are desired for optimum efficiency and effective cleaning. Twisting may include the twisting of a single fabric item about itself or the twisting of multiple fabric items about each other. Fabric articles that are not tangled help blooming, reduce the amount of bunching in the clothes washer, and help to stop the clothes washer from becoming off-balance. Blooming is the turning over of the fabric items in the wash load and is desired as it promotes uniform cleaning of the fabric items. A common form of blooming occurs when the fabric items move between the bottom of the basket to the top of the liquid. This movement can also include the fabric items moving radially inward and outward from the center of the basket to the peripheral wall of the basket.

Figure 7:
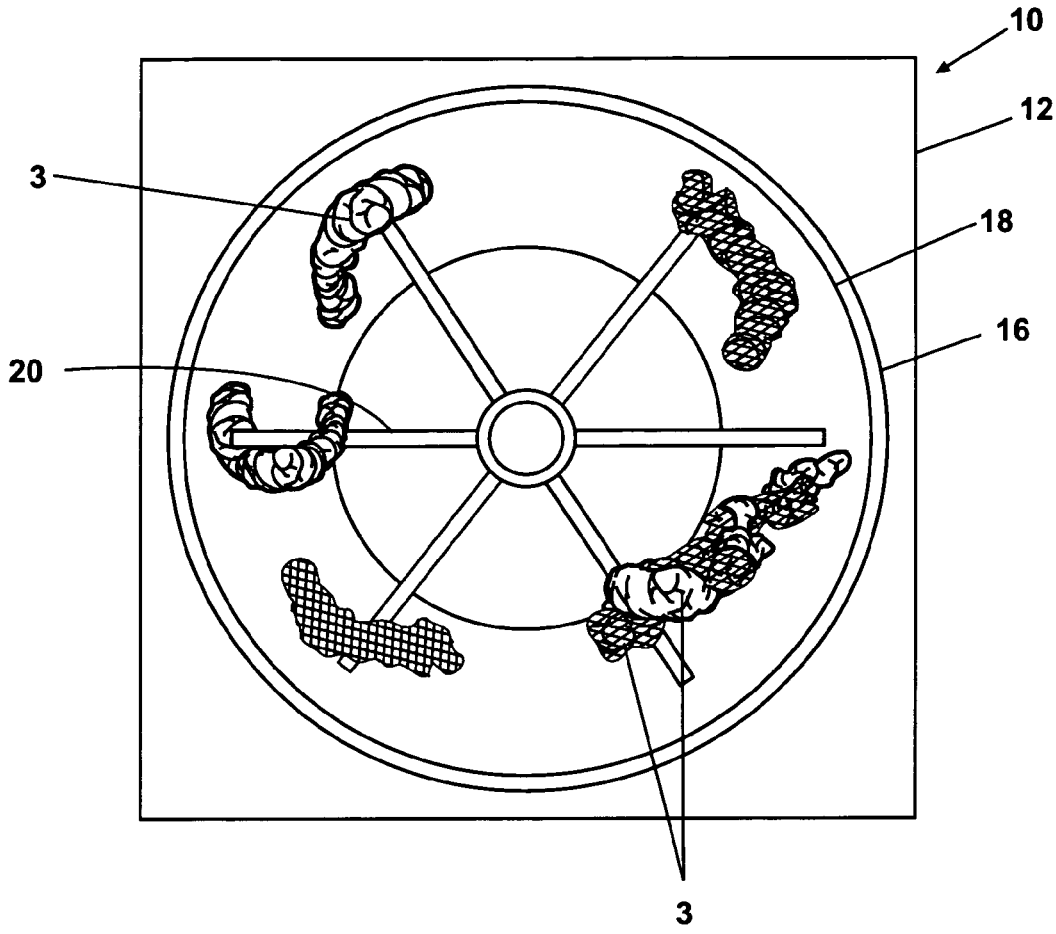
FIG. 7 is a schematic representation of fabric items in a tangled state in the cloths basket.

FIG. 7 illustrates the fabric items 2 when tangled during the wash cycle. During the wash cycle a fabric item 3 may become tangled upon itself, with other fabric articles or even around the clothes mover. The operable twisting may arise when the fabric articles move more in either of the forward or backward directions then they do in the reverse direction. This net displacement of the fabric items is relative to the impeller.

Figure 8A:
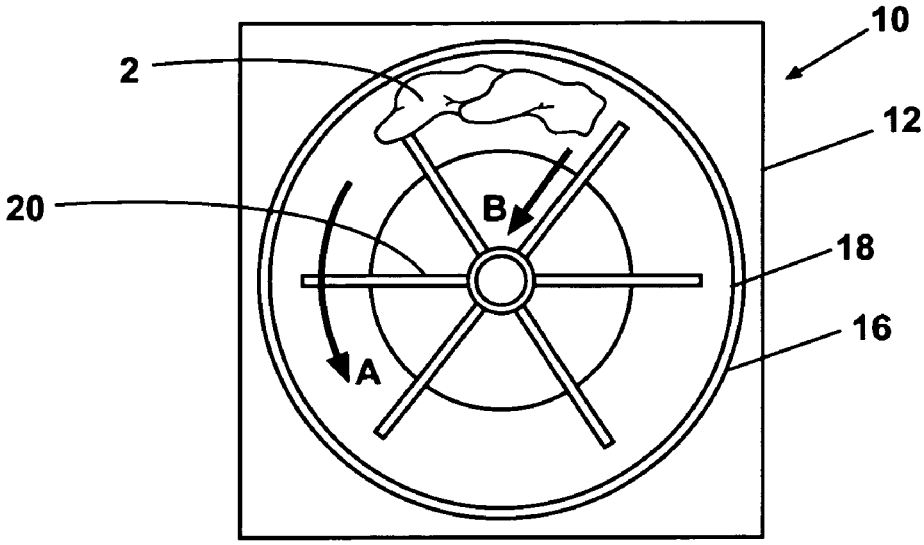
FIG. 8*a* is a schematic representation of a fabric item prior to becoming twisted.
Figure 8B:
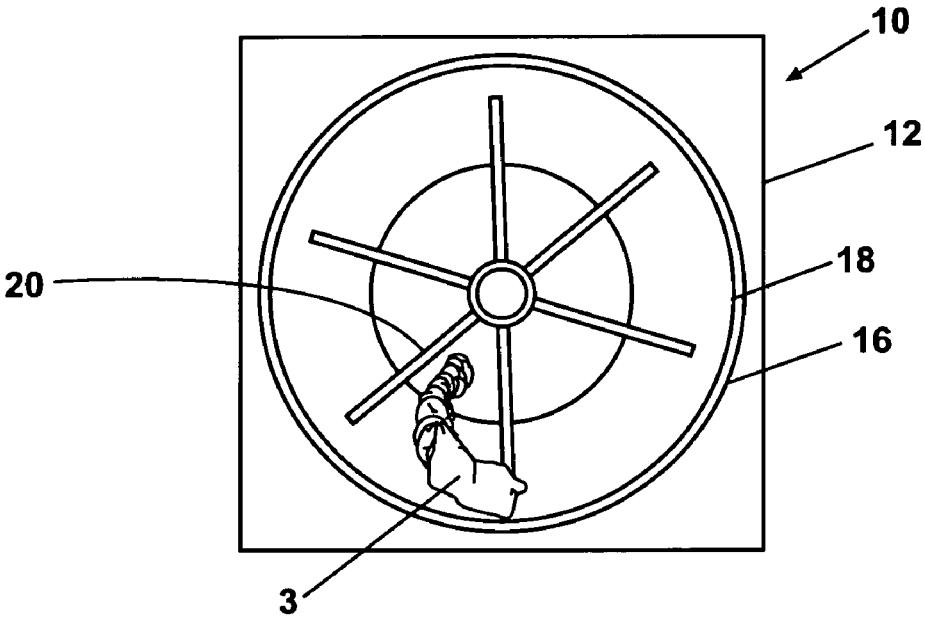
FIG. 8*b* is a schematic representation of the fabric item in FIG. 8*a* after becoming partially twisted.

FIGS. 8*a* and 8*b* schematically illustrate how an article of clothing can become twisted. A portion of the fabric article 2 can be effectively fixed to one part of the clothes mover, such as by catching on a blade or by the weight of other clothes items, while another part of the fabric item has greater relative movement. In FIG. 8*a* one end of the fabric item is shown caught on the blade and the other is free to move. Upon rotation of the clothes mover, the relatively fixed end of the fabric article moves with the blade and stays at a relatively fixed radial distance from the center of the clothes mover as shown by arrow A. However, the free end tends to move radially inward upon rotation as shown by arrow B. As the free end moves radially inward, it tends to roll on itself, which causes the twisting of the fabric article. Repeated oscillations of the clothes mover tends to cumulatively increase the twisting. While FIGS. 8*a* and 8*b* shown only a single fabric item, multiple fabric items can twist together.

It should be noted that twisting can occur whenever one portion of the fabric items moves more freely than another. Thus, twisting can occur without the fabric items being completely fixed to the clothes mover.

Tangling and twisting will continue to build and fabric articles will continue to tangle more and more unless corrected. For example, the fabric article will continue to twist and tangle as they move further in one direction. However, no net displacement exists when the fabric items have traveled approximately an equal distance backwards as they have traveled forwards. When no net displacement exists the fabric items are not considered to be tangled.

Tangling of the fabric items in the wash basket 18 may cause several disadvantageous effects in the clothes washer 10. For example, a common disadvantage may be that fabric items are more wrinkled at the end of the cycle. Another, common disadvantage may be that when fabric articles are tangled the mechanical energy imparted to them by the clothes mover 20 may be focused primarily on the outside of the tangled fabric articles, which minimizes the cleaning effect to the interior fabric articles. The cleaning effect may be reduced because the wash liquid 4 may not pass through the tangled fabric items 3 as easily as if the fabric items were more untangled. The cleaning effect may also be reduced because the tangled fabric items 3 are not able to move relative to each other and impart mechanical energy to each other.

Tangling may be further disadvantageous in that during either washing operations, where the clothes mover reciprocates, or spinning operations, where the wash basket rotates, but especially during the spinning operations, the tangled clothing may cause an out of balanced condition great enough for the wash basket to bottom out its suspension and/or contact a portion of the cabinet 12, which may be very undesirable.

Tangling may also slow the motor as the impeller blades of the clothes mover contacts the tangled fabric items. In response, the controller 32, which typically tries to move the motor 28 at a predetermined set speed for the given cycle, will increase the current to the motor 28 to attempt to increase the torque and maintain the set speed. The additional motor current results in increased costs to the consumer.

Figure 9:
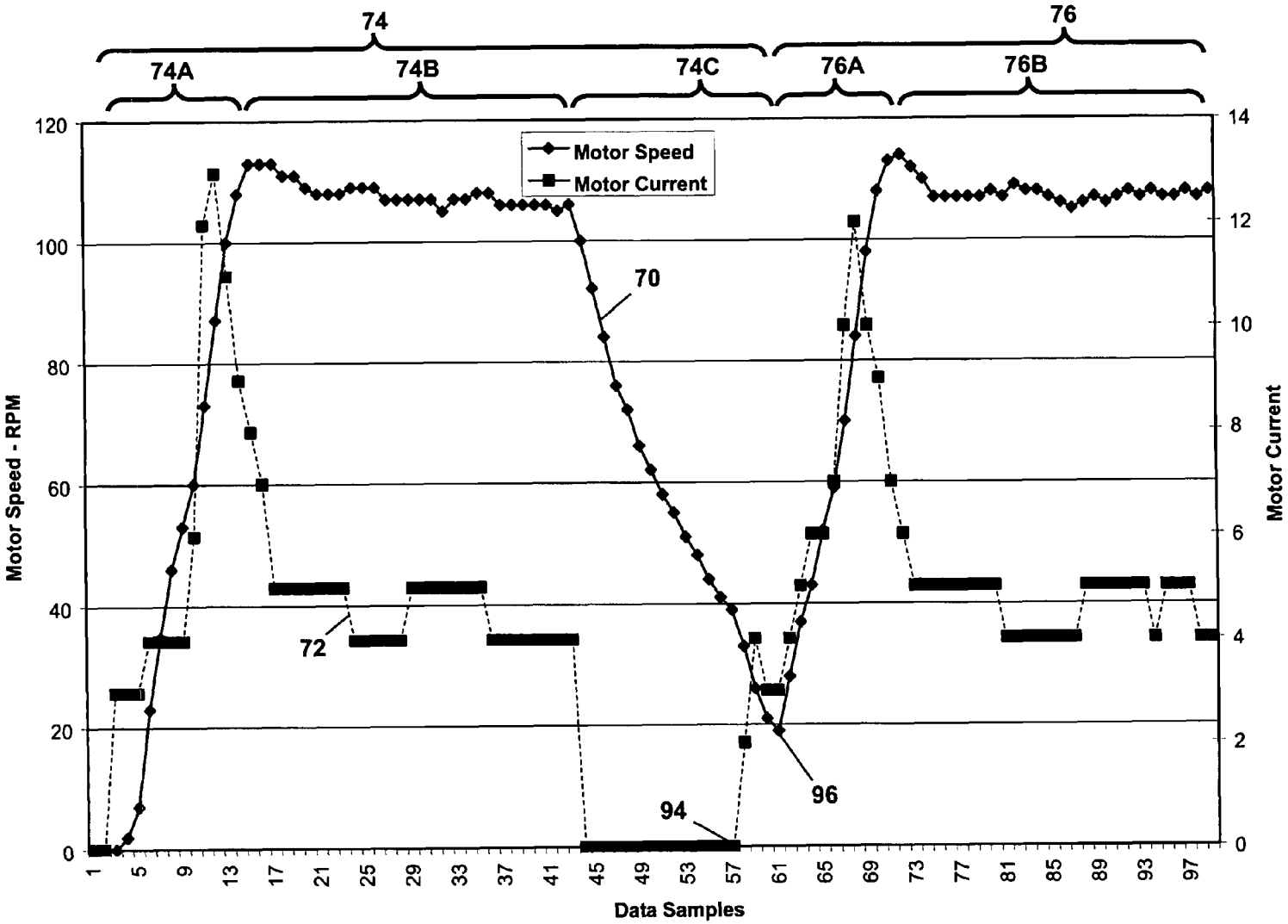
FIG. 9 is a first graphical representation of motor speed and motor current for the automatic clothes washer illustrated in FIG. 1 containing only liquid during a single cycle of the clothes mover consisting of a forward rotational stroke followed by a backward rotational stroke.

FIG. 9 graphically illustrates a waveform of the motor speed 70 and the motor current 72 during one oscillation cycle of the clothes mover 20 through a forward stroke, represented by a forward direction region 74, followed by movement in a backward stroke, represented by a backward direction region 76. The waveforms of FIG. 9 are generated by sampling the motor speed 70 and motor speed current 72 at a predetermined interval or sampling rate, which in this case constitutes 20 milliseconds. As illustrated, in the forward direction region 74 the clothes mover 20 may be quickly accelerated to a predetermined set speed 74*a*, maintained at the predetermined set speed 74*b*, and then quickly decelerated 74*c*, which may include braking, prior to reversing. Region 74*b* may often be referred to as the plateau. The backward direction region 76 may be similarly divided into an acceleration step 76*a*, a plateau 76*b*, and a deceleration step 76*c*. Thus, when the clothes mover 20 transitions from the forward stroke to the backward stroke, the motor current 72 decreases to a zero value 94, and the motor speed 70 responsively decreases to a zero or nearly zero value 96. While the decrease in speed may not be shown going to zero in FIG. 9, this results from the sampling rate for the data points—the zero speed was not sampled—not an indication that the speed does not go to zero. In reality, whenever the clothes mover changes direction, there must necessarily be a point, which might be instantaneous, where the speed equals zero.

During the forward and backward strokes as illustrated in FIG. 9, the controller controls the speed of the motor in an attempt to maintain the motor speed at a predetermined set speed, which for the example in FIG. 9 constitutes 110 rpm. Thus, the speed of the clothes mover 20 remains essentially constant at approximately the 110 rpm set speed in the plateau 74*b*, 76*b* of the curve 70. There are nominal variations or ripples in the magnitude of the motor current and motor speed in the plateaus 74*b*, 76*b* due to the nominal loading and unloading of the liquid on the clothes mover 20 associated with the engagement of the clothes mover 20 with the liquid as the clothes mover 20 moves through the liquid. This loading and unloading transmits through the clothes mover 20 and the transmission 26 to the drive motor 28 where it may be sensed by the speed sensor 31. The loading and unloading causes temporary changes in the speed of the clothes mover 20 relative to the set speed. In response, the controller 32 adjusts the current to the motor 28 in an attempt to maintain the set speed, which results in the motor current leading the speed as may be easily seen in FIG. 9.

Figure 10:
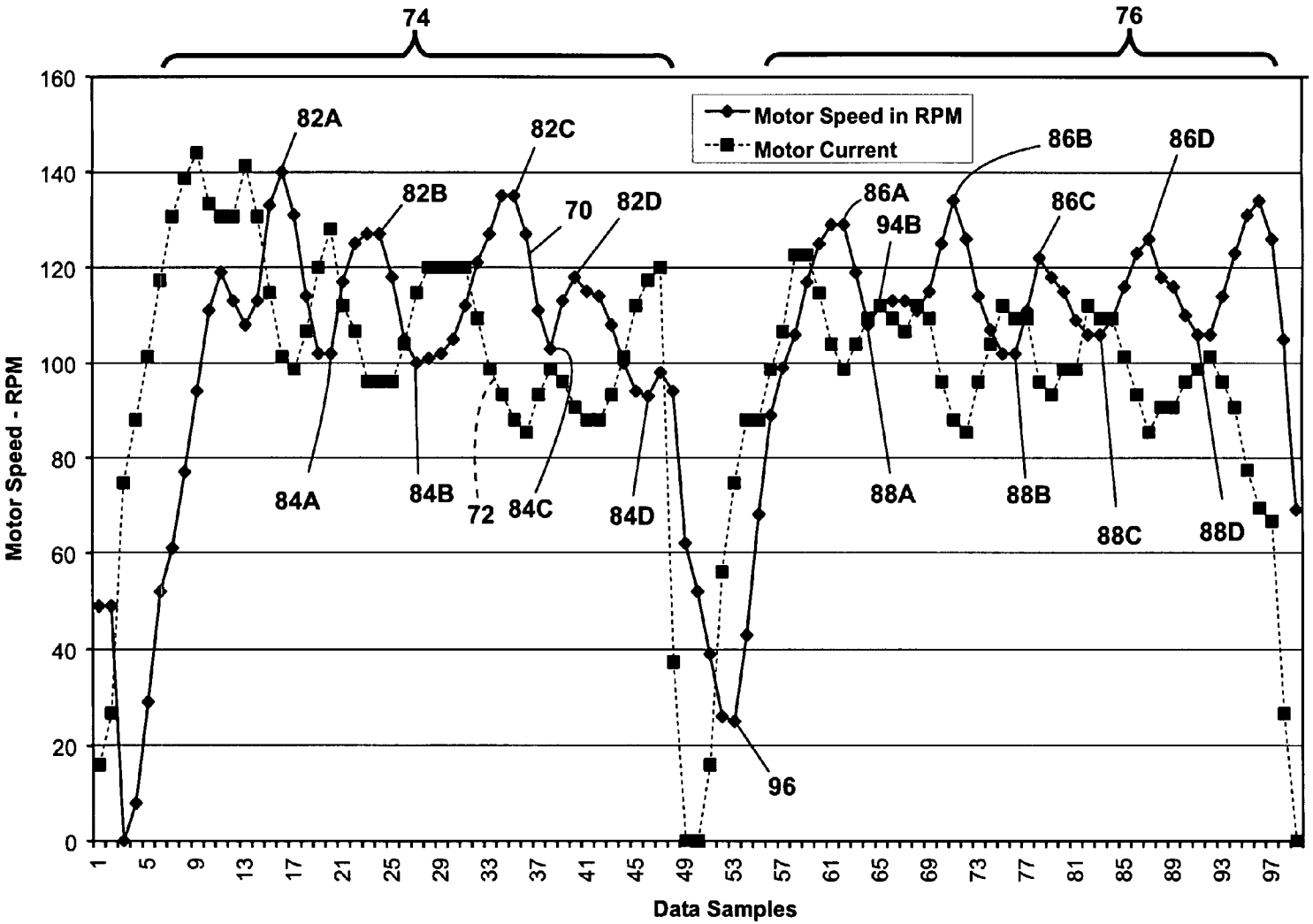
FIG. 10 graphically represents the motor speed and motor current for the automatic clothes washer illustrated in FIG. 1 containing liquid and a laundry load without tangling during a single oscillation cycle of the clothes mover consisting of a forward rotational stroke followed by a backward rotational stroke.

FIG. 10 graphically illustrates the waveforms for the motor current 72 and motor speed 70 signals attributable to the loading and unloading of the clothes mover 20 when there exists a load of generally distributed and untangled fabric items 50 in the wash chamber for one oscillation cycle of the clothes mover 20. FIG. 10 illustrates the waveforms of the motor speed 70 and motor current 72 where the motor speed set point constitutes 120 rpm and the sampling rate equals 20 milliseconds. The intermittent grabbing and slipping of the fabric items 50 with the vanes of the clothes mover 20 transmits through the clothes mover 20 and the transmission 26 to the drive motor 28, where it manifests as ripples in the waveforms of both the motor speed 70 and motor current 72. These ripples define waveforms having multiple peaks. The peaks have greater magnitude than those ripples in FIG. 9 because of the greater force associated with the laundry load as compared to the liquid alone.

Looking more closely at the ripples of the motor speed waveform in a fairly well distributed load, the ripples may be separated into peaks comprising both positive peaks 82*a-d*, 86*a-d* and negative peaks 84*a-d*, 88*a-d*. The average frequency of the ripples may be determined by comparing the number of positive/negative peaks in a specified set of sample points representing a given time. The motor speed and motor current waveforms have a quasi sinusoidal waveform for which a frequency may be determined using the peaks for the time of the plateau 74*b*, 76*b*. Similarly, the waveform of the current 72 may be separated into peaks comprising positive peaks 90*a-d*, 94*a-d* and negative peaks 92*a-d*, 96*a-d*. The peaks of the current waveform may also be used to calculate a frequency for the waveform.

As seen in FIG. 10, the motor current waveform in a fairly well distributed load shows a similar waveform to the motor speed with the current tending to lead the speed. The leading of the current relative to the motor speed results from the controller attempting to maintain the motor speed at the set speed.

Figure 11:
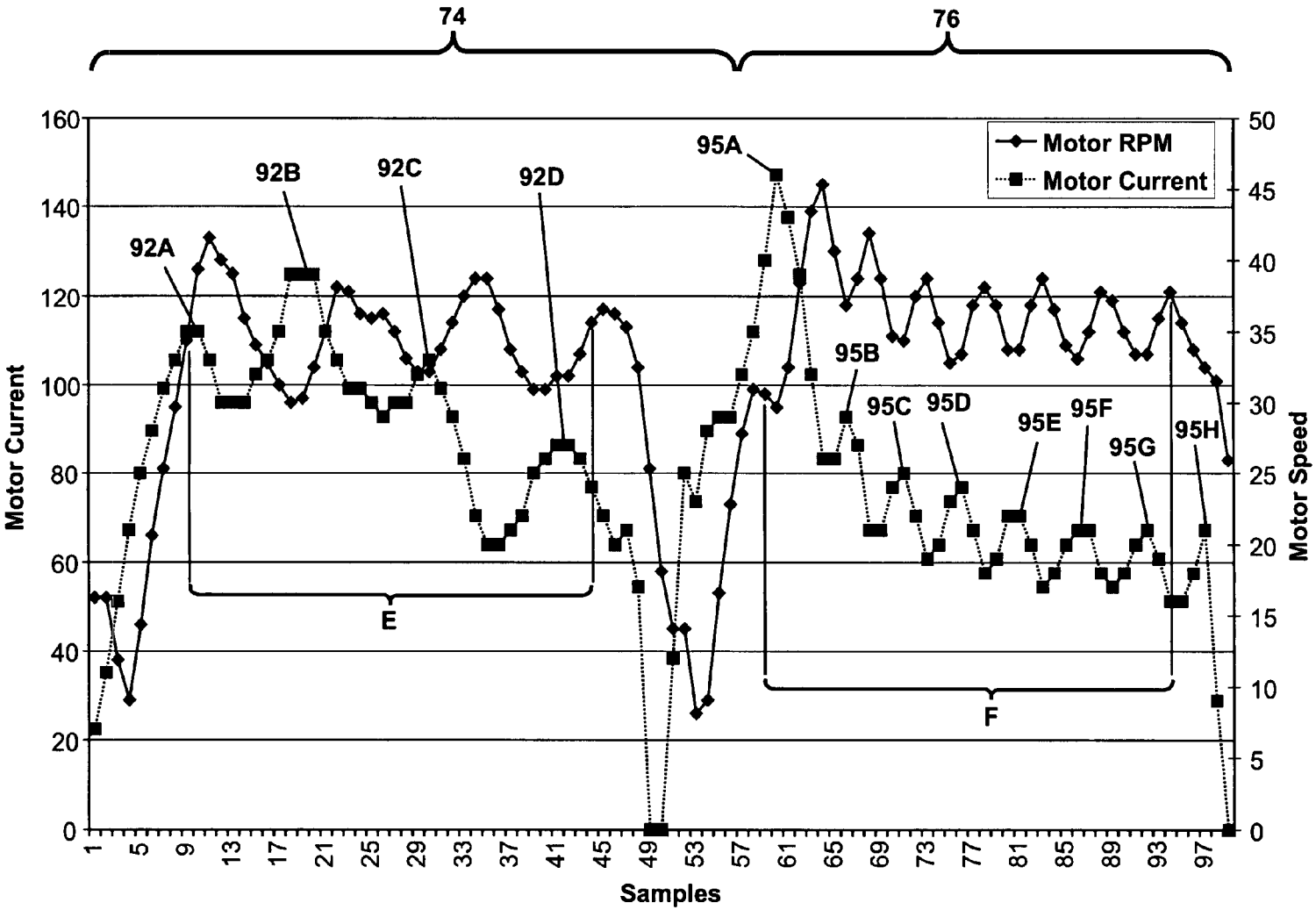
FIG. 11 graphically represents the motor speed and motor current for the automatic clothes washer illustrated in FIG. 1 containing liquid and a laundry load with tangling during a single cycle of the clothes mover consisting of a forward rotational stroke followed by a backward rotational stroke.

FIG. 11 shows an example of the current and speed waveforms that are indicative of tangling. Looking more closely at the ripples of the motor current waveform of FIG. 11, the forward stroke 74 has four positive peak points 92*a-d* while the backward stroke 76 has eight positive peak points 95*a-h*. The increased number of peaks in the backward stroke corresponds to shorter wavelengths and a higher frequency than in the forward stroke. It has been determined that the inconsistency between the frequencies of the forward and backward strokes indicates tangling exists as they represent a difference in the angular movement of the clothes in one stroke direction as compared to the other stroke direction, which results in a net angular displacement of the fabric items relative to the impeller. The frequency data may be used to determine this net angular displacement.

Applicants have determined that the motor speed and motor current data may be used to determine the degree of tangling of the fabric items, not just the possible presence of tangling. The degree of tangling of the fabric items may be determined from the motor speed data or the motor current data in real-time. In this sense, the use of the data amounts to a real-time sensor placed in the wash chamber for determining the degree of tangling. Such a sensor has never before been available.

One manner in which the frequency data can be used to determine tangling is by looking at the average frequency of one or both of the motor speed or motor current. It has been found that the average frequency provides an accurate estimate of the degree of tangling of the fabric items, thereby enabling corrective action to be taken. The average frequency may be determined over any useful segment of the waveform and then compared to assess the degree of tangling. The useful segment of the waveform may be part of a stroke, all of a stroke, or multiple strokes. The average frequency may be determined for some or all of the useful segments and can be a static average frequency or a running average frequency, weighted or not. For example, after an oscillation cycle the average frequency for each of the forward and backward strokes may be compared. The corresponding samples may be thought of as paired sections of each stroke.

The comparison may be done by determining the difference in the average frequencies, regardless of the estimation method used. This difference may be determined using whole or partial data from one or more forward or backward strokes. The difference may be determined over one or multiple pairs of forward and backward strokes. The difference may be tracked as a single difference, a running total that may be weighted or not, or as a trapped maximum difference.

The difference of the frequencies correlates to the net displacement of the fabric items. This net displacement as represented by the difference may then be compared to a predetermined threshold and the degree of tangling may then be determined. For example, if the net displacement constitutes a relatively small value and the frequencies are substantially the same the fabric items are considered to be untangled. For the washing machine on which the invention was implemented, the frequencies are considered to be substantially the same when their difference remains less than 4 Hz. It is possible that this frequency difference is machine dependent. Therefore, the difference value is illustrative and not limiting on the invention. The predetermined threshold may be a range of values or a single value. In most cases, it will be a single value that represents the threshold between acceptable and unacceptable tangling for the given washer.

A more detailed look at one implementation of determining the difference should be helpful in further understanding the invention. It should be noted that the following implementation has been based on an average frequency difference method, which has been found to provide the desired resolution for determining the degree of tangling for the contemplated washer; however, it may be contemplated that other mathematical methods may also be used.

The frequency values for either or both of the motor speed and motor current may be stored by the machine controller 32 as individual data values as well as a cumulative value. Preferably, an average of the frequency values for each of the forward and backward strokes may be determined and stored by the machine controller 32. More preferably, the difference of those average frequencies may be determined and stored as well as a sum of those differences may be determined and stored by the machine controller 32.

Looking to FIG. 11 as an example, the frequency data of the clothes mover motor speed for the forward stroke value samples are depicted as E. Motor current may also be used to determine the degree of tangling but this explanation will use only motor speed. The frequency data of the clothes mover motor speed for the backward stroke values samples are depicted as F. Ranges E and F represent corresponding samples in a waveform as each corresponds to the same range of data samples during each respective stroke, specifically each has been determined over the sample range of the plateau of the waveform (ideally a constant speed equal to the target set speed) during each respective stroke. The larger wavelengths in section E in the forward stroke 74 correlates to the forward stroke 74 having a smaller frequency then the backward stroke which has a much larger frequency and much shorter wavelengths as depicted in section F. In this manner the average frequency for those samples may be determined from the waveform and may be compared to its counterpart on the forward or backward stroke. In FIG. 11 the sampling rate results in there being fifty sets of paired samples.

The average frequency difference may be taken between such paired values.

$$\text{Net_Angular_Disp}=\{\text{Avg_}F(W(CW,n))-\text{Avg_}F(W(CCW,n))\} \quad (1)$$

where:

W is either the speed or current signal waveform;

Net_Angular_Disp is the difference between the average frequencies of the signal;

CW is a clockwise stroke of the clothes mover;

CCW is the counterclockwise stroke of the clothes mover;

"n" is the number of samples taken in each of the clockwise and counterclockwise strokes; and Avg_F is the average frequency of one of the forward or backward strokes for the "n" samples taken.

The Net_Angular_Disp value expressed as an absolute value, may then be examined to determine the degree of tangling because the absolute value of the Net_Angular_Disp value represents the amount of net angular displacement of the fabric items relative to the impeller. The formulas below represent the comparison made between the absolute value of the Net_Angular_Disp and a threshold value T where no substantial angular displacement of the fabric items exists.

$$|\text{Net_Angular_Disp}|>T=\text{Fabric items are tangled} \quad (2)$$

$$|\text{Net_Angular_Disp}|<=T=\text{Fabric items are not tangled} \quad (3)$$

The threshold value T may be any value which amounts to relatively no net displacement. This T represents the fabric items in an untangled state where no corrective action needs to be taken. So, an absolute value of the Net_Angular_Disp less than or equal to the threshold value T indicates the fabric items are not tangled. An absolute value of the Net_Angular_Disp greater than the threshold value T indicates the fabric items are tangled and that corrective action should be taken.

Furthermore, a Sum of all of the Net_Angular_Disp values for duration of oscillation cycle may be determined. This Sum would give the net tangling measure for that duration. The Sum may be represented by the formula:

$$\text{Sum}=\Sigma_{m=1}^{m=M}\text{Net_Angular_Disp}(m) \quad (4)$$

where:

M represents the number of oscillation cycles used to compute the Sum; and m is the speed or current Net_Angular_Disp determination.

It is currently contemplated that M will represent the number of oscillation cycles and the net angular displacement will be calculated for a sample corresponding to a complete oscillation cycle. In that way, the Sum will be a total of the net angular displacement for multiple oscillation cycles. However, as the Net_Angular_Disp determination need not be on an oscillation cycle bases, the Sum also need not be on an oscillation cycle basis.

An absolute value of this Sum value may then be compared to a threshold.

$$|\text{Sum}|>T=\text{Fabric items are tangled} \quad (5)$$

$$|\text{Sum}|<=T=\text{Fabric items are not tangled} \quad (6)$$

The threshold value T will either be any value which amounts to relatively no net displacement. This T represents the fabric items in an untangled state where no corrective action needs to be taken. So an absolute value of the Sum less than or equal to the threshold value T indicates the fabric items are not tangled. An absolute value of the Sum greater than the threshold value T indicates the fabric items are tangled and that corrective action needs to be taken.

An illustrative example of the use of the tangling detection during the operation of the washing machine should be helpful in understanding the tangling detection within the washing operation. During a fill step in a wash cycle, the clothes mover 20 may be rotated through a pre-selected number of preliminary oscillation cycles, for example five, while an addition of water to the wash chamber takes place, or after an initial filling of the clothes washer 10. Thus, the clothes mover 20 rotates through five forward strokes and five backward strokes while the machine controller 32 keeps track of the degree of tangling using the previously described method. This may be accomplished by the machine controller receiving data samples of the motor speed or motor current from the sensor 31, trapping the values of the average frequency for each of the forward and backward strokes in the oscillation cycle, determining the difference between the two average frequencies and maintaining the differences of the average frequencies. At the end of one cycle, the absolute value of the frequency difference or the absolute value of the net angular displacement of the clothing, |Net_Angular_Disp|, may be compared to a preselected threshold value, T. Alternatively or additionally, a comparison may also be made at the end of multiple cycles. The machine controller 32 uses the determination of the degree of tangling to control the operation of the clothes washer. Specifically the machine controller 32 will take corrective action to untwist the tangled clothing if the absolute value of the net angular displacement of the fabric items exceeds than the threshold.

It should be noted that other types of threshold comparisons may exist. As described, the absolute value of the net angular displacement determined value may be compared on a greater than or less than basis. However, the threshold could be picked in such a way that the comparison may be done on a greater than basis, less than basis, less than or equal to basis, or on a basis which does not require the absolute value to be taken. The type of comparator may normally be controlled by how the threshold number may be quantified The ability to determine or sense the degree of tangling benefits the improvement of the wash performance as actions may be taken to reduce the tangling. Once one has the ability to determine the degree of tangling, one may then manipulate the wash cycle accordingly to control the degree of tangling, including eliminating any tangling. One way to use the determined degree of tangling to manipulate the wash cycle is to control the length of at least one of the forward and backward strokes of the clothes. The clothes mover may be controlled to increase or decrease the length of at least one of the forward or backward stroke. It has been contemplated that the forward stroke length may be changed, that the backward stroke length may be changed or that both stroke lengths may be changed so that compensation may be made for the displacement of the fabric items relative to the impeller. Changing the length of one of the forward or backward strokes may reduce or eliminate the angular displacement by essentially making up the distance lost in the movement of the fabric articles. More specifically, the corrective action increases the stroke length of the of the forward and backward stroke having the lesser of the determined average frequency and/or decrease the stroke length of the forward and backward stroke having the greater of the determined average frequency. For example if the absolute values of the Net_Angular_Disp value is greater than the threshold than there is tangling. Further more if the Net_Angular Disp value is negative this indicates the fabric items need to be moved further in a clockwise direction to untangle the fabric item and if the Net_Angular_Disp value is positive this indicates the fabric items need to be moved further in a counterclockwise direction to untangle the fabric items So at the end of the corrective strokes the fabric items will have less of a net angular displacement and will be in less of a tangled state. This corrective action may be continued until to the wash cycle ends. Thus, the determined degree of tangling may be used to adjust the stroke lengths of the clothes mover and thereby control the degree of tangling.

Furthermore, the machine may also be stopped if the degree of tangling happens to be high enough for safety reasons and so damage will not be done to the machine. Moreover, if the net angular displacement value or the sum net angular displacement value becomes less than the threshold the forward and backward strokes may be lengthened, shortened or evened as necessary.

The stroke length adjustments may be conducted at any time during the wash cycle. For example, it may be part of the filling step or it may be part of the wash or rinse steps. In this way, the fabric items may be untangled as soon as tangling or twisting detection occurs. This also acts as a safety step if fabric items are irreparably tangled immediately upon a user loading the clothing into the washing machine. The machine may be immediately stopped before damage occurs to the machine or the clothing.

The predetermined threshold value may represent an optimal level where there may be no need to adjust the stroke length because no substantial net angular displacement of the fabric items exists which reflects an optimal combination of cleaning effort and cleaning efficiency. An optimal level has been reached when the net angular displacement of the fabric items represented by the frequency difference value or the sum net angular displacement stays within the preselected threshold value.

The invention described herein provides an optimized laundering cycle by setting the length of at least one of the forward and backward strokes sufficient for satisfactorily cleaning a laundry load, thereby reducing the tangling of fabric items in the load. Thus, the items being laundered are cleaned more efficiently, cleaned better, and are less wrinkled thereby saving the consumer costs related to cleaning and recleaning. Finally, the utilization of motor speed and/or motor current in determining optimal stroke lengths requires no additional instrumentation, thereby minimizing additional cost. The invention simply utilizes readily available information in a new manner to control an operation in order to optimize the laundering performance of a clothes washer.

While the invention has been specifically described in connection with certain specific embodiments thereof, it may be understood that this constitutes an illustration and not a limitation. Reasonable variation and modification are possible within the scope of the forgoing disclosure and drawings without departing from the spirit of the invention which has been defined in the appended claims.

What is claimed is:

1. A method for controlling the operation of an automatic washer comprising a wash tub in which is disposed a wash basket defining a wash chamber for receiving fabric articles and an article mover located within the wash chamber and driven by a motor to impart mechanical energy to the fabric articles, the method comprising: determining the presence of ripples, which are caused by the loading and unloading of the fabric articles on the clothes mover, of at least one of the speed and current waveforms of the motor during a steady state operation of the motor; determining a frequency of the ripples; determining a degree of tangling of the fabric articles from the determined frequency; and controlling an operating cycle of the automatic washer based on the determined degree of tangling.

2. The method according to claim 1 wherein the determining of the frequency comprises determining the frequency for each of the forward stroke and backward stroke.

3. The method according to claim 2 wherein the stroke length is not adjusted when the frequencies are substantially the same.

4. The method according to claim 3 wherein the frequencies are substantially the same when their difference is less than 4 Hz.

5. The method according to claim 2 and further comprising comparing the frequency of the forward stroke to the frequency of the backward stroke.

6. The method according to claim 5 wherein the comparing of the frequency of the forward stroke and frequency of the backward stroke comprises determining the greater of the frequency of the forward stroke and frequency of the backward stroke.

7. The method according to claim 5 wherein comparing the frequencies comprises determining the difference between the frequencies.

8. The method according to claim 1 wherein the controlling of the operating cycle comprises adjusting a stroke length of at least one of the forward and backward strokes in response to the determined tangling.

9. The method according to claim 8 wherein the adjusting of the stroke length comprises adjusting the stroke length of one of the forward and backward strokes based on the determined frequency.

10. The method according to claim 8 wherein the stroke length is adjusted for each pair of forward and backward strokes.

11. The method according to claim 5 wherein the adjusting of the stroke length comprises adjusting the stroke length of the one of the forward and backward strokes having the greater frequency.

12. The method according to claim 7 wherein the stroke length is adjusted to compensate for the determined difference between the frequencies.

13. The method according to claim 12 wherein the stroke length is adjusted for each pair of forward and backward strokes.

14. A method for controlling the operation of an automatic washer comprising a wash tub in which is disposed a wash basket defining a wash chamber for receiving fabric articles and an article mover located within the wash chamber and driven by a motor to impart mechanical energy to the fabric articles, the method comprising: rotating the article mover alternating between forward and backward strokes; determining the presence of ripples, which are caused by the loading and unloading of the fabric articles on the clothes mover, of at least one of the speed and current waveforms of the motor during the forward and backward strokes; determining an average frequency of the ripples for each of the forward and backward strokes; determining a degree of tangling of the fabric articles based on a difference between the average frequency of the forward and backward strokes; and controlling an operating cycle of the automatic washer based on the determined degree of tangling.

15. The method according to claim 14 wherein the average can be of multiple forward strokes and multiple backward strokes.

* * * * *